United States Patent [19]

Forman et al.

[11] Patent Number: 4,541,583

[45] Date of Patent: Sep. 17, 1985

[54] CONTINUOUS LAYON ROLLER FILM WINDER

[75] Inventors: Edward W. Forman, Palmyra; Mark F. Kozlowski, Pittsford, both of N.Y.

[73] Assignee: Mobil Oil Corporation, New York, N.Y.

[21] Appl. No.: 690,082

[22] Filed: Jan. 9, 1985

[51] Int. Cl.[4] ..... B65H 19/26; B65H 19/06

[52] U.S. Cl. ..... 242/56 A; 242/64

[58] Field of Search ..... 242/56 A, 64, 65, 67.1 R

[56] References Cited

U.S. PATENT DOCUMENTS

| | | | |
|---|---|---|---|
| 3,123,315 | 3/1964 | Couzens | 242/56 A |
| 3,734,423 | 5/1973 | Kataoka | 242/56 A |
| 3,784,122 | 1/1974 | Kataoka | 242/56 A |

*Primary Examiner*—Stuart S. Levy
*Assistant Examiner*—Lloyd D. Doigan
*Attorney, Agent, or Firm*—Alexander J. McKillop; Michael G. Gilman; Charles J. Speciale

[57] ABSTRACT

A continuous winder which produces individual rolls of sheet material having a high quality finish. This is accomplished by maintaining a surface-winding layon roller in contact with each roll throughout the entire winding operation. The winder is comprised of a support frame having a turrent mounted therein which carries a plurality of spindles onto which the individual rolls are wound. A double layon roller assembly is mounted in the frame so that one of the layon rollers is in contact with a first spindle during the winding operation. A length counter generates a signal which starts the transfer operation when a roll is wound whereupon a second spindle is brought up to speed and a cutter is extended adjacent the sheer of the material. Simultaneously, an auxillary layon roller is moved into contact with the second spindle. Adhesive on the second spindle pulls the web onto the cutter starts the winding on the second spindle. The cutter is retracted, and the turret is indexed approximately 30°. The auxillary layon roller remains in contact with the second spindle during this indexing while the primary layon roller remains in contact with the first spindle. When the primary layon roller clears the finished roll, the second primary layon roller moves into contact with the second spindle. The auxillary layon roller is retracted and the turret is indexed approximately an additional 60° to move the second spindle to the normal roll buildup position.

11 Claims, 8 Drawing Figures

CONTINUOUS LAYON ROLLER FILM WINDER

DESCRIPTION

1. Technical Field

The present invention relates to an apparatus for winding a continuous web of sheet material onto individual rolls and more particularly relates to a continuous winding apparatus wherein a surface-winding layon roller is always in contact with the roll of material being wound throughout the winding operation.

2. Background Art

The advantages of surface or layon roll winding for producing individual rolls of sheet material from a continuously-fed web of said material has long been known in the industry and is routinely practiced on "slitting-rewinding" winding machines. These machines, while producing a neatly wound roll of material, are relatively slow in operation since the winding operation must be stopped or slowed drastically at the end of each roll of material while the continuous web of material is transferred to a new output roll.

Layon rolls have also been used in automatic cutover turret winders wherein a layon roller is kept in contact with the roll of material being wound throughout most of the winding operation. However, there is a period during the indexing of the winder turret and prior to the web transfer when the layon roll is withdrawn from contact with the roll being wound. Although this period of non-contact is relatively short, it nevertheless results in significant distortion or "crinkling" of the outermost layers or wraps of material on the wound roll. This distortion is usually severe enough to prevent the damaged material from being used for its intended purpose and therefore must be removed and discarded when the wound roll is put in use. Where one roll of material after another is used, the losses due to this unusable material can be a consideration in the overall economics of a particular commercial operation.

To overcome this problem of distorting the outer wraps of a wound roll of material, at least three known techniques have been developed commercially. One such method consists of the universal "surface" winder in which several surface drums or rolls are fixed in position and the roll being wound is transferred linearly from one roll to the next thereby allowing a new roll to be started at the first position. Another method of maintaining continuous layon roller contact with a roll being wound is to mount layon rollers directly on the winder turret with one layon roller being provided for each winding spindle on the turret. These layon rollers are indexed with the turret from the winding to the cutoff positions. A major disadvantage of this method is that the wound roll must be unloaded from one side of the machine, the turret indexed, and the empty winding core loaded on the opposite side of the machine. Still another method utilizes external auxillary layon rollers which contact the roll being wound during the indexing motion after having taken over the surface winding function from a main layon roller at the normal winding position. While, each of these methods have experienced some success, none have been able to provide a roll of material having a finished quality equal to that of rolls wound by the non-continuous operating "slitter-rewinder" machines.

DISCLOSURE OF THE INVENTION

The present invention provides a continuously operating winding apparatus which produces individual rolls of sheet material having a finished quality of rolls wound by "slitter-rewinder" machines in a continuous winding mode. This is accomplished by maintaining a surface-winding layon roller in contact with the roll of material being wound throughout the entire winding operation.

More specifically, the present winder apparatus is comprised of a support frame having a surface winding turret mounted therein. The turret carries a plurality of spindles (e.g. four) onto which are fitted cardboard cores or the like onto which the individual rolls of material are to be wound. Each spindle is driven by a motor which is normally operated in a torque mode to maintain a desired tension in the material as it is being wound. A separate motor indexes the turret upon command.

A double layon roller assembly is mounted in the frame so that one of the layon rollers is in contact with one or the first of the spindles during the primary stage of the winding operation. The layon roller is driven at a controlled speed to surface-wind the roll of material on the spindle at a speed to match that at which the web of material is being fed through the winder. A length counter measures the length of the material being wound and when the desired length is reached, the counter generates a signal which starts the transfer operation.

When this occurs, an empty or second spindle is brought up to speed and a cutter in the housing is extended adjacent to the web of the material. Almost simultaneously, a motor-driven, auxillary layon roller is moved into contact with the second spindle. Adhesive or the like on the core on the second spindle pulls the web onto the cutter to sever the web and start the winding of the material on the second spindle.

The cutter is then retracted, and the turret is indexed approximately 30°. The auxillary layon roller is moved so that it remains in contact with the second spindle during this initial indexing step while the primary layon roller moves to remain in contact with the finished roll of material on the first spindle. At the end of this step, the primary layon roller clears the finished roll and the second layon roller of the primary double layon roller rotates around into contact with the roll of material now being wound on the second spindle. When the primary layon roller comes into contact with the second spindle, the auxillary layon roller is retracted and the turret is indexed approximately an additional 60° to move the second spindle to the normal roll buildup position. The finished roll is then removed and replaced with a new spindle at one position and the winding operation is continued without interruption.

It can be seen from the above that a surfacewinding layon roller is in contact with the roll of material being wound at all times from start to finish. This produces a finished roll with little or no distortion in the outer layers of the roll but one which can be wound continuously and thereby at a greater productivity than a previous roll of this quality. It is also seen that the unloading and loading of the winder is accomplished at one position on the winder.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
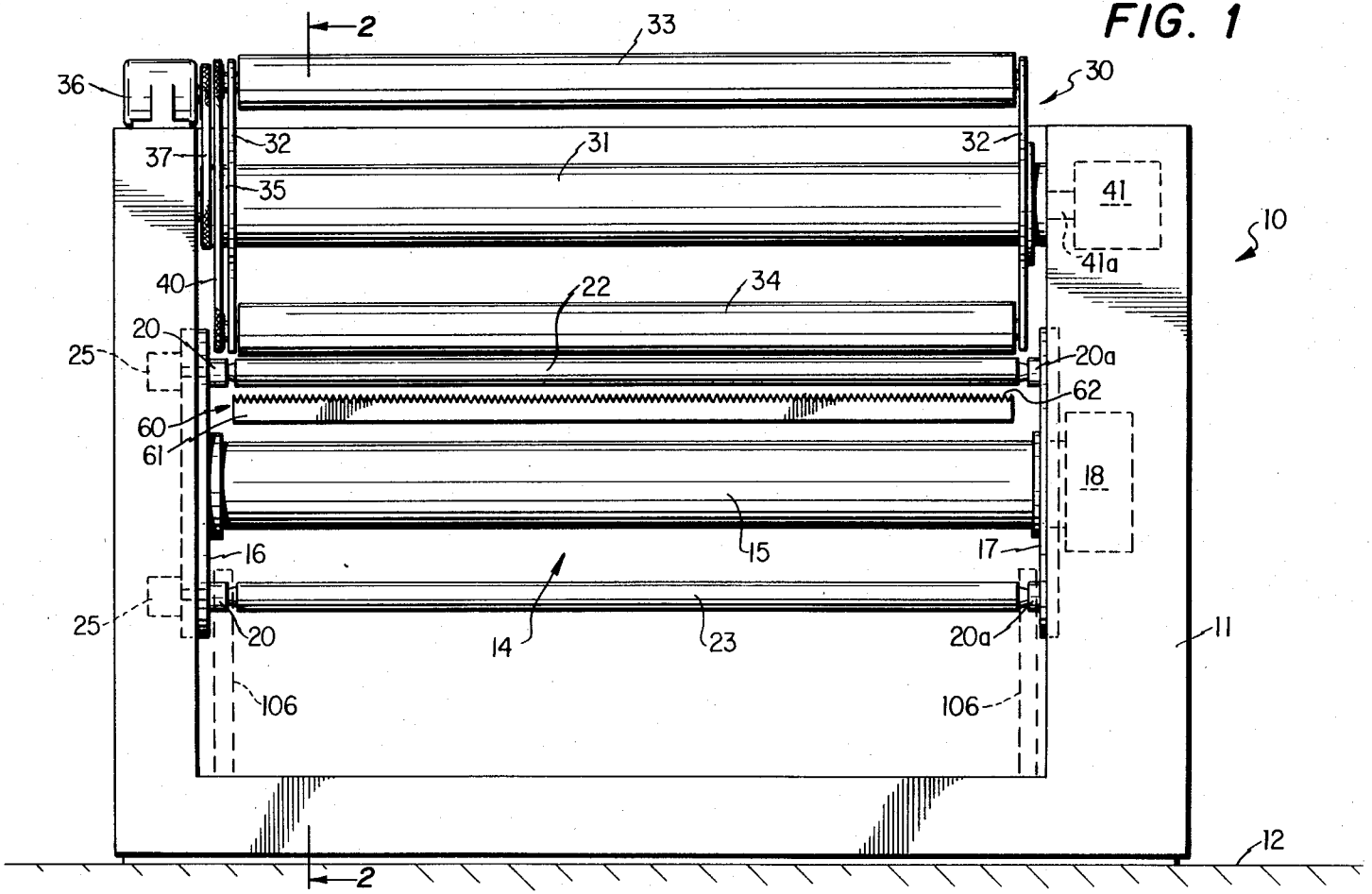
FIG. 1 is a front, view of the continuous film winder in accordance with the present invention.
Figure 2:
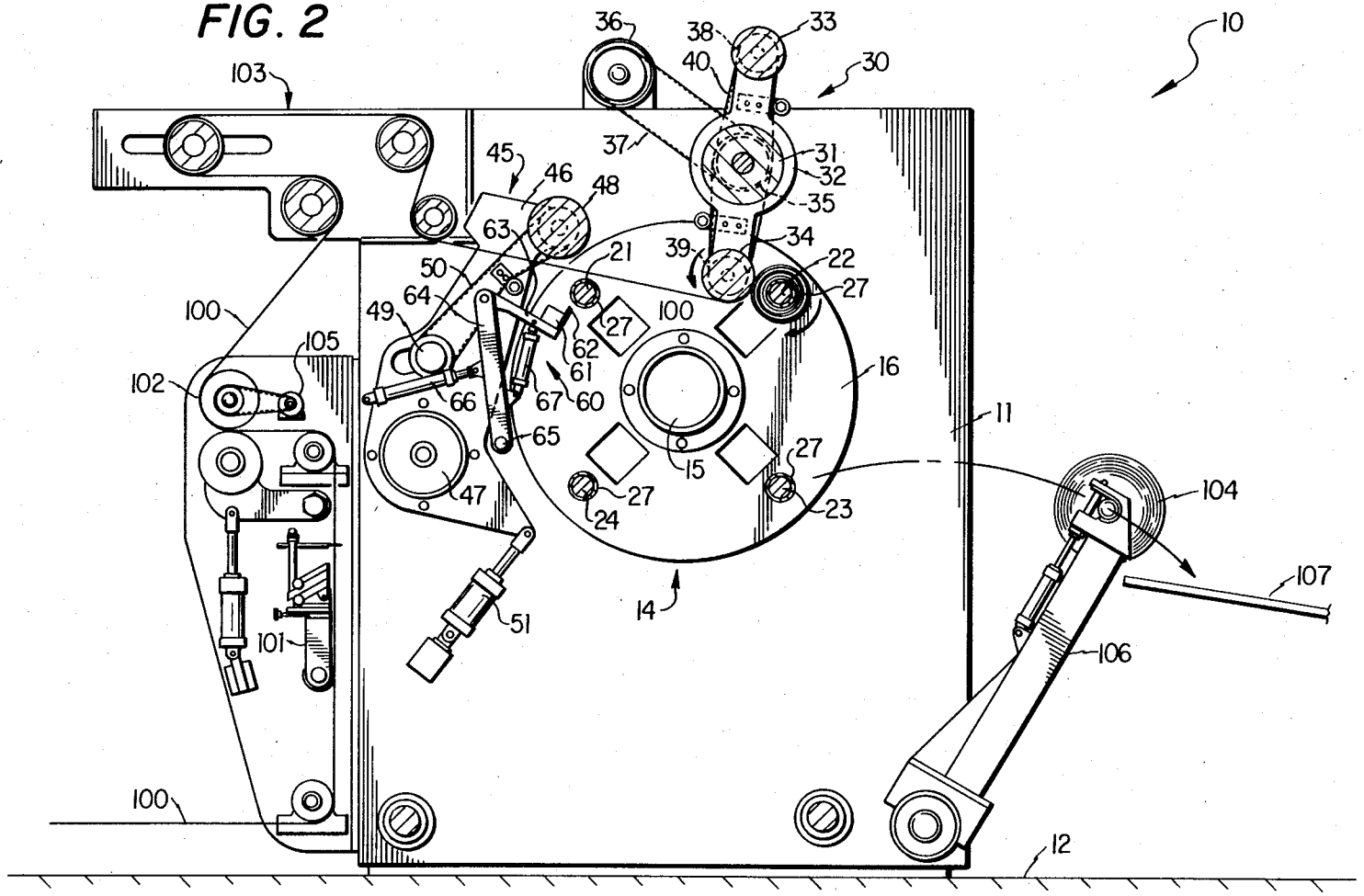
FIG. 2 is a cross-sectional view taken along line 2—2 of FIG. 1.

Referring more particularly to the drawings, FIGS. 1 and 2 discloses a continuous-operating, film winder apparatus 10 having a support frame or housing 11 which is adapted to set on floor 12. Mounted within housing 11 is surface-winding turret 14 which is comprised of a spool-like structure having an axle 15 with plates 16, 17 affixed near the ends thereof, said plates being journalled for rotation within housing 11. Motor means 18 is operably connected to turret 14 to rotate same upon command.

Each plate 16, 17 carrys a plurality of releasable chuck means **20, 20*a*, respectively, which are linearly aligned in pairs to receive and drive respective spindles 21, 22, 23, 24. Individual motors 25 (two shown in FIG. 1) are carried by plate 16 and each is operably connected to its respective chuck means 20 to independently rotate same. Motors 25 are preferably electric motors and are of the type which are operated in a torque-mode (e.g. a shunt-wound, DC motor such as distributed by General Electric) for a purpose which will be explained in more detail below. A cardboard tube or core 27 or the like is frictionally fitted over each of spindles 21, 22, 23, 24** and is adapted to be rotated therewith whereby sheet material will be wound thereon during the winding operation to form individual rolls of material.

Positioned within housing 11 at a point above turret 14 is primary double layon roller assembly 30. Assembly 30 is comprised of an axle 31 which has its ends journalled for rotation in housing 11. Support members 32 are fixed to axle 31 near the ends thereof and have primary layon rollers 33, 34 journalled therebetween. A driving pulley 35 is rotatably mounted on one end of axle 31 between housing 11 and support 32 and is driven by motor 36 through belt 37 or the like. Each of layon rollers 33, 34 have a pulley 38, 39, respectively, fixed thereto which, in turn, are driven by driving pulley 35 through belt 40 or the like. Motor means 41 is operably connected to axle 31 through a torque-controlled clutch **41*a*, e.g. magnetic particle clutch, to continuously impart a torque to bias assembly in a counterclockwise direction as viewed in FIG. 2**. The clutch is set to slip when a primary layon roller is in contact with a winding product roll.

Referring now to FIG. 2, auxillary layon roller assembly 45 comprises a pair of bell crank supports 46 (only one shown) fixed on either end of axle 47 which, in turn, extends across the housing 11 and is rotatably mounted in the opposite sides of housing 11. Journalled between the bell cranks supports 46 is auxillary layon roller 48 which is driven by motor 49 through belt 50 or the like. Auxillary layon roller is approximately the same length and diameter as those of primary layon rollers 33, 34. Bell cranks 46 are rotated about axle 47 by pneumatically operated cylinders 51 mounted to either side of housing 11 (only one shown).

Also, positioned within housing 11 and extending thereacross is cutter assembly 60 comprising a bar 61 having a serrated cutting surface 62 thereon. Bar 61 has a support 63 affixed near either end thereof which, in turn, is pivotably connected to one end of an arm 64 (only one shown in FIG. 2). The other end of arm 64 is pivotably connected at pivot 65 to the side of housing 11 and is rotatable about pivot 65 by means of pneumatically-operated piston 66 or the like. Pneumatic piston 67 rotates support 63 relative to arm 64 as will be more fully explained below.

Figure 3:
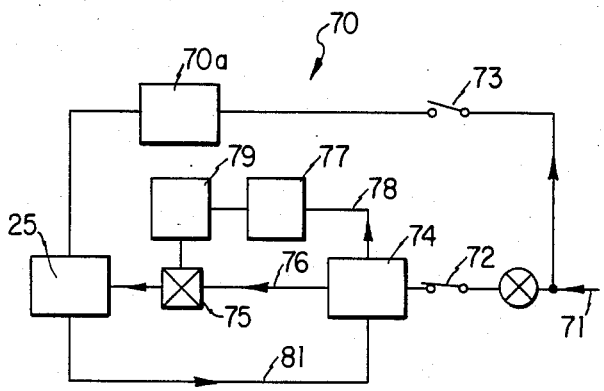
FIG. 3 is a simplified schematic of the drive circuit for a motor driving a respective spindle of the winder of FIG. 1.

Referring now to FIG. 3, an individual drive circuit 70 is provided for each of the spindle motors 25. Since all of the drive circuits 70 are identical, only one will be described in detail. Spindle drive 70 has two modes of operation: (1) a speed mode through drive circuitry **70*a* when relay or switch 73 is closed and switch 72 is open; and (2) a torque mode when switch 73 is open and switch 72 is closed. Motor 25 is operated in the speed mode to bring the spindle being driven by motor 25 up to surface speed match just before the web of sheet material is transferred thereto. Motor 25 is operated in the torque mode to maintain the proper tension in the web as the roll of material builds up on the spindle being driven by motor 25**.

A predetermined line or reference signal (e.g. voltage) is applied to line 71 to control motor 25 in the torque mode during the winding operation. This signal is fed to radius calculator 74 which is a programmed torque controller that outputs a torque reference signal as a function of the diameter of the roll of material on the spindle being driven by motor 25 (i.e. line speed of the web divided by the spindle speed). This torque reference signal is fed to summing junction 75 through line 76 and also through line 78 to a "taper" control circuit 77 which modifies the signal to vary the rate at which torque is applied to the spindle drive to compensate for the increasing diameter of material on the spindle. This signal is further modified by "tension" potentiometer 79 to set the minimum desired torque for the spindle before it is fed to motor 25 through junction 75. As will be understood by one skilled in the art, the taper and tension control circuits can provide a varying function of web tension as the diameter of the material being wound on the spindle increases. Feedback loop 80 insures that maximum torque is not exceeded.

Figure 4:
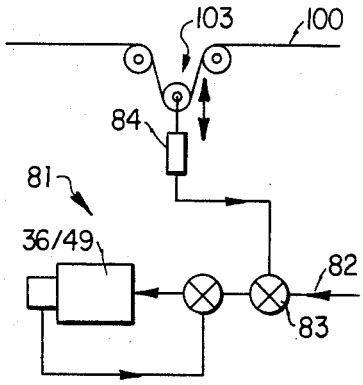
FIG. 4 is a simplified schematic of the drive circuit for a motor driving a respective layon roller of the winder of FIG. 1.

FIG. 4 discloses a simplified illustration of the drive circuit 81 which is identified for both motor 36 which drives the primary layon roller assembly 30 and motor 49 which drives the auxillary layon roller assembly 45. A predetermined line or reference signal (i.e. voltage) is applied to line 82 having a value which will power the respective motor at its desired speed. This signal is fed to summing junction 83 where it is adjusted by a signal from potentiometer 84 which, in turn, is actuated by the position of dancer assembly 103. As understood in the art, the position of dancer 103 automatically adjusts in response to the tension in the web 100 of sheet material to maintain a relative constant tension in web 100 during the winding operation. This dancer, such as one provided by Worldwide Converting Corp, can be adjustably loaded to control a desired web tension level in the web between the slitter nips and the nip formed by the layon roll and the product roll. The signal from potentiometer 84 modifies the reference signal to constantially trim the speed of motor 36/49 and hence the speed of the layon rollers to thereby maintain the surface speed equal to the web speed at some set level of web tension. A closed feed-back loop 85 provides a signal from motor-driven tachometer 86 to summing junction 87 to maintain motor 36/49 at its desired speed. Many types of standard drive modes, including no-drive or even a brake, can be applied to the winding spindles or layon rolls to effect a given characteristic of a winding mode. Winding modes from pure surface winding to pure center winding and all combinations of surface winding with center assist are possible.

Figure 5A:
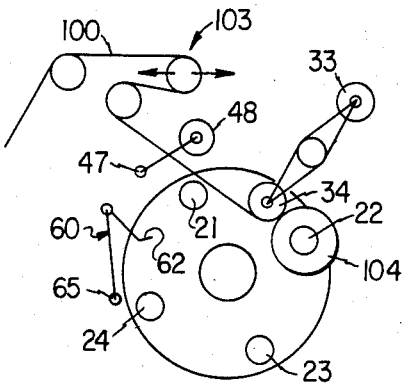
FIGS. 5A–5D are schematical views of the sequence of steps carried out by the continuous film winder of FIG. 1 during an indexing and film transfer operation.
Figure 5B:
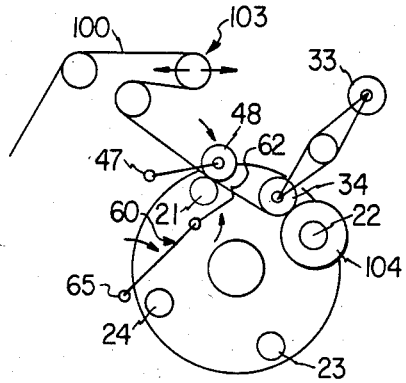

The operation of winder 10 is as follows. A continuous web 100 of material (e.g. a thin sheet of polyethylene film such as used in stretch-wrap packaging) is threaded into winder 10 as shown in FIG. 2 and passes through a slitter section 101 which trims or slits web 100 into separate webs. These webs are handled as one and will be referred to collectively as web 100. Web 100 through nip rollers 102 (which feed web 100 at a set speed), over dancer 103 and onto core 27 on first spindle 22 where the material is being wound. This is the same step of the winding operation which is represented in FIG. 5A. As the finished roll 104 approaches its final diameter, length counter 105 (driven by nip roller 102; see FIG. 2) will have measured the desired length of material 100 and will generate a signal which starts motor 25 in its speed mode to bring second spindle 21 up to line speed. Cylinders 66 and 67 are then actuated in order to move cutter 60 first forward and then upward to position cutting edge 62 adjacent the lower edge of web 100 (FIG. 5B). Almost simultaneously, cylinder 51 (FIG. 2) is actuated to rotate auxillary layon roller 48 (which is being driven by motor 49) downward into contact with second spindle 21. Adhesive on core 27 on spindle 21 pulls web 100 onto cutting edge 62 thereby severing the web and transferring same to spindle 21.

Figure 5C:
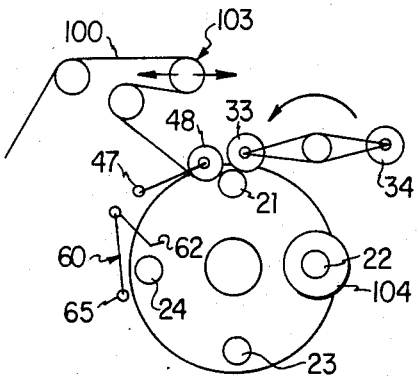

Immediately after web transfer, the cutting means 60 is retracted and motor 18 (FIG. 1) is actuated to index turret 14 approximately 30° (e.g. 29°). Bell crank 46 (FIG. 2) allows auxillary layon roller 48 to move so that it remains in contact with core 27 on second spindle 21 so that second spindle 21 is being driven at the proper speed during this indexing to insure uniform winding of material 100 on core 27 on second spindle 21. While indexing is taking place, first primary layon roller 34 follows finished roll 104 on first spindle 22 under the influence of torque motor 41 (FIG. 1). As first primary layon roller 34 clears finished roll 104, double layon roller assembly 30 is free to be rotated by the torque from motor 41 until second primary layon roller 33 comes into contact with the material now being wound on second spindle 21 (FIG. 5C). As first primary roller 34 comes clear of the finished roll 104, motor 25 driving spindle 22 is brought to a braked stop.

Figure 5D:
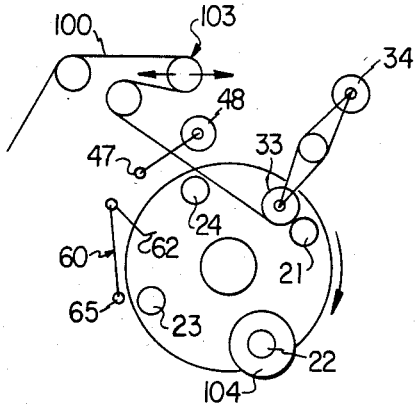

With second primary layon roller 33 now running in contact with the material being wound on second spindle 21, cylinder 51 indexes auxillary layon roller 48 away from contact with second spindle 21. Turret 14 completes its indexing sequence by moving an additional approximate 60° (e.g. 61°) to its roll buildup position (FIG. 5D). Finished roll 104 is then unloaded by actuating a pair of arms 106 (FIGS. 1 and 2) forward to engage the ends of spindle 22, retracting chuck means 20, **20*a*, retracting arms 105 and finished roll 104, and releasing roll 104 onto an inclined ramp 107 or the like. By reversing this unloading sequence, an empty spindle can then be loaded into the chuck means of spindle 21** and the winding operation is continued without interruption.

We claim:

1. A winder apparatus for winding individual rolls of sheet material from a continuous web of said material, said apparatus comprising:

a frame;

a turret rotatably mounted in said frame;

a plurality of spindles carried by said turret, each of said spindles adapted to sequentially wind an individual roll of said sheet material;

means in said frame adapted to feed said continuous web of said material onto a first of said plurality of spindles; at a roll build-up position;

a primary layon roller assembly mounted in said frame;

means for moving said primary layon roller assembly into contact with said continuous web on said first spindle during the winding of said material on and said first spindle;

means for cutting said continuous web of said material;

means for transferring said continuous web of said material from said first spindle to a second of said plurality of spindles, said transferring means including an auxillary layon roller;

means for moving said auxillary layon roller into contact with said continuous web on said second spindle during said transfer of said continuous web to said second spindle;

means for indexing said turret to change the relative positions of said plurality of spindles whereby said second spindle is moved toward the roll build-up position previously occupied by said first spindle and moving said first spindle toward a unloading position;

means for moving said auxillary layon roller to maintain said auxillary layon roller in contact with said second spindle during at least the initial rotation of said turret;

means for moving said primary layon roller from contact with said first spindle and into contact with said second spindle during said indexing of said turret; and means for retracting said auxillary layon roller out of contact with said second spindle.

2. The apparatus of claim 1 including:

means for removing said first spindle and loading an empty spindle on said turret when said first spindle is at said unloading position.

3. The apparatus of claim 1 including:

means for driving plurality of spindles to maintain a desired torque on each respective spindle during winding of said material on said respective spindle.

4. The apparatus of claim 3 including:

means to drive said primary layon roller assembly at a desired speed; and means to drive said auxillary layon roller at a desired speed.

5. The apparatus of claim 1 wherein said primary layon roller comprises:

a double layon roller support rotatably mounted in said frame; and a first primary layon roller and a second primary layon roller journalled in said support.

6. The apparatus of claim 5 including:

means for driving said first and second primary layon rollers at a desired speed; and means for driving said auxillary layon roller at a desired speed.

7. The apparatus of claim 6 including:

means to rotate said double layon roller support for moving said first and said second primary layon rollers into and out of contact with said spindles.

8. A winder apparatus for winding individual rolls of sheet material from a continuous web of said material, said apparatus comprising:

a frame;

a turret rotatably mounted in said frame, said turret comprising:

an axle journalled in said frame;

a pair of plates, one of said plates affixed to near one end of said axle and the other of said plates affixed to near the other end of said axle;

four spindles journalled between said plates, said spindles being spaced at 90° intervals in respect to said axle;

means for driving each of said spindles at a desired torque;

means in said frame adapted to feed said continuous web of material onto a first of said four spindles;

a primary layon roller assembly mounted in said frame, said assembly comprising:

an axle journalled in said frame;

a pair of supports, one of said supports affixed to near one end of said axle and the other of said supports affixed to near the other end of said axle;

a first primary layon roller journalled between said supports near one of their outer ends, and a second primary layon roller journalled between said supports near the other of their outer ends;

means for driving said first and said second primary layon rollers at a desired speed;

means for moving said first primary layon roller into contact with first of said four spindles when said continuous web of material is to be wound on said first spindle;

means in said frame for cutting said continuous web of said material;

means for transferring said continuous web of said material from said first spindle to a second of said four spindles, said transferring means including:

an auxillary layon roller movably mounted in said frame;

means for driving said auxillary layon roller at a desired speed;

means for moving said auxillary layon roller into contact with said second spindle during said transfer of said continuous web to said second spindle;

means for rotating said turret to move all of said spindles whereby said second spindle is moved toward the position previously occupied by said first spindle;

means for moving said auxillary roller as said turret is rotated to thereby maintain said auxillary layon roller in contact with said second spindle during at least the first 29° of rotation of said turret;

means for moving said first primary layon roller out of contact with said first spindle and for moving said second primary layon roller into contact with said second spindle during rotation of said turret; and means for retracting said auxillary layon roller out of contact with said second spindle.

9. The surface-winding apparatus of claim 8 wherein said driving means for said spindles includes:

an electric motor operable in the torque mode operably connected to each of said four spindles.

10. The apparatus of claim 9 wherein said driving means for said first and second primary layon rollers include:

an electric motor operable in a speed mode operably connected to said first and second primary layon rollers;

and wherein said means for driving said auxillary layon roller include:

an electric motor operable in a speed mode operably connected to said auxillary layon roller.

11. The apparatus of claim 10 wherein said means for moving said first primary layon roller into contact with said first spindle and said means for moving said first primary layon roller out of contact with said first spindle and said second primary layon roller into contact with said second spindle comprises:

a torque-controlled clutch means drivably connected to said axle of said primary layon roller assembly; and an electric motor operably connected to said clutch means.

* * * * *